US008848007B2

(12) United States Patent
Lee

(10) Patent No.: US 8,848,007 B2
(45) Date of Patent: Sep. 30, 2014

(54) ORGANIC LIGHT EMITTING DIODE DISPLAY AND METHOD FOR DRIVING THE SAME

(75) Inventor: Hwanjoo Lee, Daegu (KR)

(73) Assignee: LG Display Co., Ltd., Seoul (KR)

( * ) Notice: Subject to any disclaimer, the term of this patent is extended or adjusted under 35 U.S.C. 154(b) by 427 days.

(21) Appl. No.: 13/234,329

(22) Filed: Sep. 16, 2011

(65) Prior Publication Data

US 2012/0139977 A1 Jun. 7, 2012

(30) Foreign Application Priority Data

Dec. 1, 2010 (KR) ..... 10-2010-0121512

(51) Int. Cl.

| | |
|---|---|
| ***G09G 5/10*** | (2006.01) |
| ***G09G 5/00*** | (2006.01) |
| ***G09G 3/34*** | (2006.01) |
| ***G09G 3/32*** | (2006.01) |

(52) U.S. Cl.

CPC ..... *G09G 3/3208* (2013.01); *G09G 2330/022* (2013.01)

USPC ..... 345/691; 345/690; 345/211; 345/84

(58) Field of Classification Search

USPC ..... 345/589, 204, 690–691, 84; 362/97.1–97.3

See application file for complete search history.

(56) References Cited

U.S. PATENT DOCUMENTS

| | | | | |
|---|---|---|---|---|
| 2006/0119553 | A1* | 6/2006 | Akima | 345/77 |
| 2007/0273682 | A1* | 11/2007 | Yi et al. | 345/211 |
| 2008/0001863 | A1 | 1/2008 | Kim et al. | |
| 2009/0027373 | A1* | 1/2009 | Chiang et al. | 345/212 |
| 2009/0213033 | A1* | 8/2009 | Chen | 345/1.1 |
| 2010/0085368 | A1* | 4/2010 | Shin et al. | 345/534 |

FOREIGN PATENT DOCUMENTS

| | | | |
|---|---|---|---|
| CN | 1120284 | A | 4/1998 |
| CN | 101026709 | A | 8/2007 |
| KR | 10-2004-0062060 | | 7/2004 |
| KR | 10-2006-0114476 | | 11/2006 |
| TW | 200910320 | | 3/2009 |

OTHER PUBLICATIONS

Taiwanese Office Action dated Dec. 12, 2013 for corresponding Patent Application No. 100131735.

* cited by examiner

*Primary Examiner* — Kent Chang
*Assistant Examiner* — Nelson Rosario
(74) *Attorney, Agent, or Firm* — Morgan, Lewis & Bockius LLP

(57) ABSTRACT

Embodiments of the invention relate to an organic light emitting diode (OLED) display and a method for driving the same. The OLED display includes a data driving circuit configured to output a data voltage to the display panel; a scan driving circuit configured to sequentially output a scan pulse synchronized with the data voltage to a display panel; and a timing controller configured to decide whether or not the multicolor data are inputted, to control the scan driving circuit and the data driving circuit in a normal mode when the multicolor data are inputted, and to control the scan driving circuit and the data driving circuit in a current saving mode when the multicolor data are not inputted.

24 Claims, 12 Drawing Sheets

FIG. 3

| Mode | DET | BIST | Clock Out | DE Out | Data Out | RESET Out |
|---|---|---|---|---|---|---|
| Current saving mode | 1 | 1 | VCO Clock | FFDE | FFR/FFG/FFB | RESET |
| | 1 | 0 | `L´ | `L´ | `L´ | `L´ |
| Normal mode | 0 | 1 | CLK | DE | RGB | RESET |
| | 0 | 0 | CLK | DE | RGB | RESET |

ORGANIC LIGHT EMITTING DIODE DISPLAY AND METHOD FOR DRIVING THE SAME

This application claims the benefit of Korean Patent Application No. 10-2010-0121512 filed on Dec. 1, 2010, the entire contents of which is incorporated herein by reference for all purposes as if fully set forth herein.

BACKGROUND OF THE INVENTION

1. Field of the Invention

Embodiments of the invention relate to an organic light emitting diode (OLED) display and a method for driving the same.

2. Discussion of the Related Art

With the development of information society, the demand for various types of display devices for displaying an image is increasing. Various flat panel displays, such as a liquid crystal display, a plasma display panel, and an organic light emitting diode (OLED) display, have been recently used. Out of the flat panel displays, the OLED display has excellent characteristics including a low voltage drive, a thin profile, a wide viewing angle, and a fast response time. Especially, an active matrix type OLED display for displaying an image on a plurality of pixels, which are arranged in a matrix form, has been widely used.

In the OLED display, a timing controller receives RGB data from a host system and supplies the RGB data to a data driving circuit. The timing controller receives timing signals, such as a clock and a data enable from the host system, and generates control signals for controlling each of the data driving circuit and a scan driving circuit. The control signals include (i) a scan timing control signal for controlling the scan driving circuit and (ii) a data timing control signal for controlling the data driving circuit. The data driving circuit converts the RGB data into a data voltage in response to the data timing control signal and outputs the data voltage to the data lines of a display panel of the OLED display. The scan driving circuit sequentially supplies a scan pulse synchronized with the data voltage to scan lines of the display panel in response to the scan timing control signal.

Even when the timing controller does not receive the RGB data from the host system, however, the timing controller generates the control signals for controlling the data driving circuit and the scan driving circuit. For example, the RGB data are not received from the host system when the host system does not receive digital video signal from an external component due to the turn-on or the turn-off of the display device. More specifically, even when the timing controller does not receive the RGB data from the host system and the OLED display displays a black image, the timing controller still generates the control signals. Accordingly, unnecessary power consumption is generated in the timing controller, the data driving circuit, and the scan driving circuit.

SUMMARY OF THE INVENTION

The present invention relates to an organic light emitting diode display and a method for driving the same. One object of the present invention is to provide an organic light emitting diode display and a method for driving the same which can reduce its power consumption.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose according to one aspect of the invention, an organic light emitting diode (OLED) display may include: a data driving circuit configured to output a data voltage to the display panel; a scan driving circuit configured to sequentially output a scan pulse synchronized with the data voltage to a display panel; and a timing controller configured to decide whether or not the multicolor data are inputted, to control the scan driving circuit and the data driving circuit in a normal mode when the multicolor data are inputted, and to control the scan driving circuit and the data driving circuit in a current saving mode when the multicolor data are not inputted.

In another aspect, there is a method for driving an organic light emitting diode (OLED) display including comprising the step of: (a) outputting a data voltage to the display panel; (b) sequentially outputting a scan pulse synchronized with the data voltage to a display panel; and (c) deciding whether or not the multicolor data are inputted, controlling the scan driving circuit and the data driving circuit in a normal mode when the multicolor data are inputted, and controlling the scan driving circuit and the data driving circuit in a current saving mode when the multicolor data are not inputted.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 3 is a table illustrating outputs of a clock selection output unit, a data enable (DE) selection output unit, a data selection output unit, and a reset signal selection output unit in response to a BIST signal and a DET signal;

DETAILED DESCRIPTION OF THE EMBODIMENTS

Figure 1:
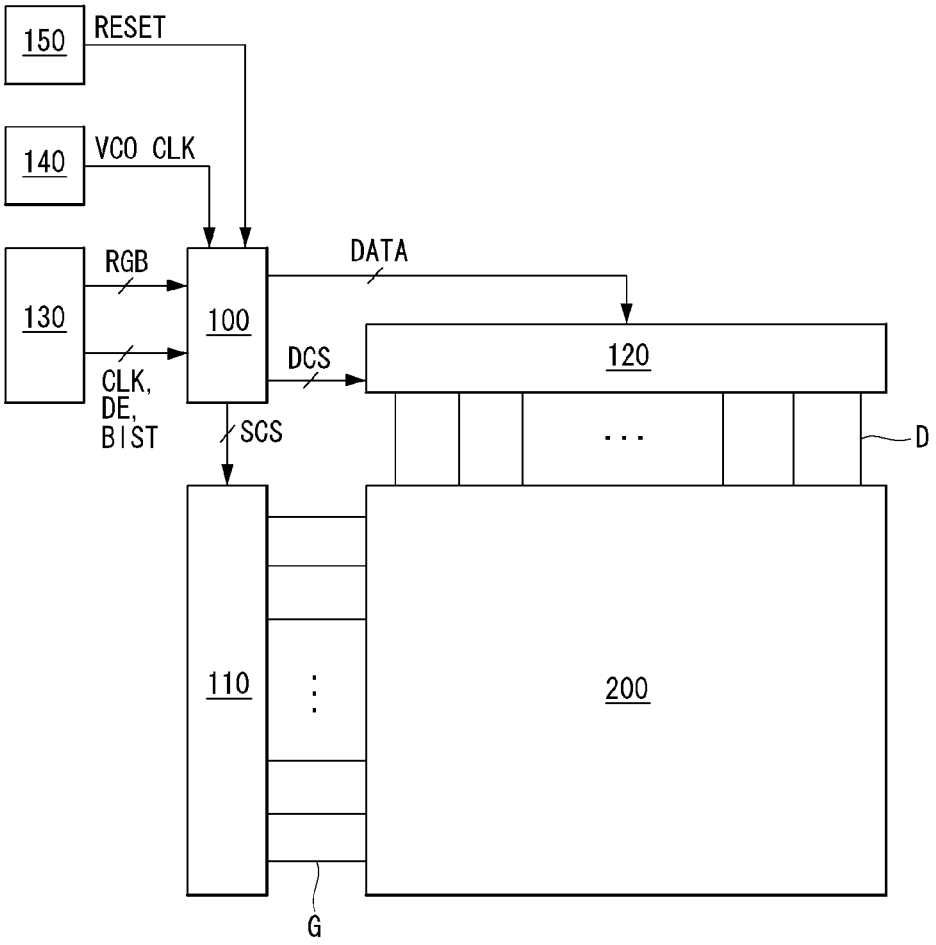
FIG. 1 is a block diagram schematically illustrating an organic light emitting diode (OLED) display according to an exemplary embodiment of the invention.

The invention will be described more fully hereinafter with reference to the accompanying drawings, in which example embodiments of the inventions are shown. The invention may, however, be embodied in many different forms and should not be construed as limited to the embodiments set forth herein. Like reference numerals designate like elements throughout the specification. In the following description, if it is decided that the detailed description of known function or configuration related to the invention makes the subject matter of the invention unclear, the detailed description is omitted.

Names of elements used in the following description may be selected in consideration of facility of specification preparation. Thus, the names of the elements may be different from names of elements used in a real product.

FIG. 1 is a block diagram schematically illustrating an organic light emitting diode (OLED) display according to an exemplary embodiment of the invention. As shown in FIG. 1, the OLED display according to the exemplary embodiment of the present invention includes a display panel 200, a timing controller 100, a scan driving circuit 110, a data driving circuit 120, a host system 130, a voltage controlled oscillator (VCO) 140, and a reset signal output unit 150.

The display panel 200 includes data lines D, scan lines G crossing the data lines D, and a pixel array (not shown) including a plurality of pixels arranged in a matrix form. The pixel array controls a current flowing in OLEDs (or the OLED element) using thin film transistors (TFTs), thereby displaying an image. Each of the pixels of the pixel array may include a red subpixel, a green subpixel, and a blue subpixel. Each pixel may further include a driving TFT, at least one switching TFT, a storage capacitor, and the like. The pixels may be implemented by any known structure. Each pixel is connected to the data line D and the scan line G through the switching TFT. Each pixel receives a data voltage from the data driving circuit 120 through the data line D and receives a scan pulse from the scan driving circuit 110 through the scan line G.

The timing controller 100 receives multicolor data (e.g. RGB data RGB), from the host system 130 and supplies the RGB data RGB to the data driving circuit 120. The timing controller 100 receives timing signals, such as a dot clock CLK and a data enable DE, and a built-in self test (BIST) signal BIST from the host system 130 and generates control signals for controlling each of the scan driving circuit 110 and the data driving circuit 120. The control signals include a scan timing control signal SCS for controlling the scan driving circuit 110 and a data timing control signal DCS for controlling the data driving circuit 120.

The RGB data used herein may be replaced by other multicolor data, including, but not limited to, the combination of yellow, cyan, magenta (YCM), red, green, blue, and yellow (RGBY), or red, green, blue, and white (RGBW), or even red, green, blue, yellow, and cyan (RGBYC).

According to some embodiments of the present invention, the timing controller 100 decides whether or not the RGB data RGB are inputted. When the RGB data RGB are inputted to the timing controller 100, the timing controller 100 respectively outputs the scan timing control signal SCS and the data timing control signal DCS to the scan driving circuit 110 and the data driving circuit 120 in a normal mode. When the RGB data RGB are not inputted to the timing controller 100, the timing controller 100 respectively outputs the scan timing control signal SCS and the data timing control signal DCS to the scan driving circuit 110 and the data driving circuit 120 in a current saving mode.

In the normal mode described herein, the timing controller 100 outputs the scan timing control signal SCS and the data timing control signal DCS in response to the RGB data RGB, the dot clock CLK, and the data enable DE. When the BIST signal BIST of a high (or "1") logic level is inputted to the timing controller 100 in the current saving mode, the timing controller 100 outputs the scan timing control signal SCS and the data timing control signal DCS that allow the display panel 200 to sequentially display images of various colors, including, but not limited to, red, green, blue, white, and/or black images. Further, when the BIST signal BIST of a low (or "0") logic level is inputted to the timing controller 100 in the current saving mode, the timing controller 100 outputs the scan timing control signal SCS and the data timing control signal DCS that allow the display panel 200 to display an image of a single color, such as a black image. In other words, the BIST signal BIST controls the scan timing control signal SCS and the data timing control signal DCS and allows the display panel 200 to display the images of various colors or an image of a single color in the current saving mode. The timing controller 100 is described below with reference to FIG. 2.

The data driving circuit 120 includes a plurality of source driver integrated circuits (ICs). The data driving circuit 120 converts digital video data DATA into the data voltage in response to the data timing control signal DCS output from the timing controller 100 and outputs the data voltage to the data lines D.

The data timing control signal DCS may include a source start pulse, a source sampling clock, a polarity control signal, a source output enable, and the like. The source start pulse controls a shift start timing of the source driver ICs. The source sampling clock controls a sampling timing of data inside the source driver ICs based on a rising or falling edge thereof. The polarity control signal controls a polarity of the data voltage output from the source driver ICs. If a data transfer interface between the timing controller 100 and the source driver ICs is a mini low voltage differential signaling (LVDS) interface, the source start pulse SSP and the source sampling clock SSC may be omitted.

The scan driving circuit 110 sequentially supplies the scan pulse synchronized with the data voltage to the scan lines G in response to the scan timing control signal SCS output from the timing controller 100. The scan driving circuit 110 may be directly formed on the lower substrate of the display panel 200 through a gate-in-panel (GIP) method, or may be connected between the scan lines G of the display panel 200 and the timing controller 100 through a tape automated bonding (TAB) method. The lower substrate may be formed of glass. In the GIP method, a level shifter may be mounted on a printed circuit board (PCB).

The scan timing control signal SCS may include a gate start pulse, a gate shift clock, a gate output enable, and the like. The gate start pulse is inputted to the scan driving circuit 110 and controls a shift start timing. The gate shift clock is inputted to the level shifter and level-shifts. The gate shift clock is then input to the scan driving circuit 110 and shifts the gate start pulse. The gate output enable controls an output timing of the scan driving circuit 110.

The host system 130 supplies the RGB data RGB to the timing controller 100 through an interface, such as a low voltage differential signaling (LVDS) interface and a transition minimized differential signaling (TMDS) interface. The host system 130 supplies the timing signals, such as the dot clock CLK and the data enable DE, and the BIST signal BIST to the timing controller 100.

The VCO 140 generates and outputs the VCO clock VCO CLK to the timing controller 100. When the BIST signal BIST of the high logic level is inputted to the timing controller 100 in the current saving mode, the VCO clock VCO CLK performs timing logic processing instead of the dot clock CLK. The reset signal output unit 150 outputs a reset signal RESET to the timing controller 100. The reset signal RESET is a signal allowing the timing logic processing of the timing controller 100 to start.

Figure 2:
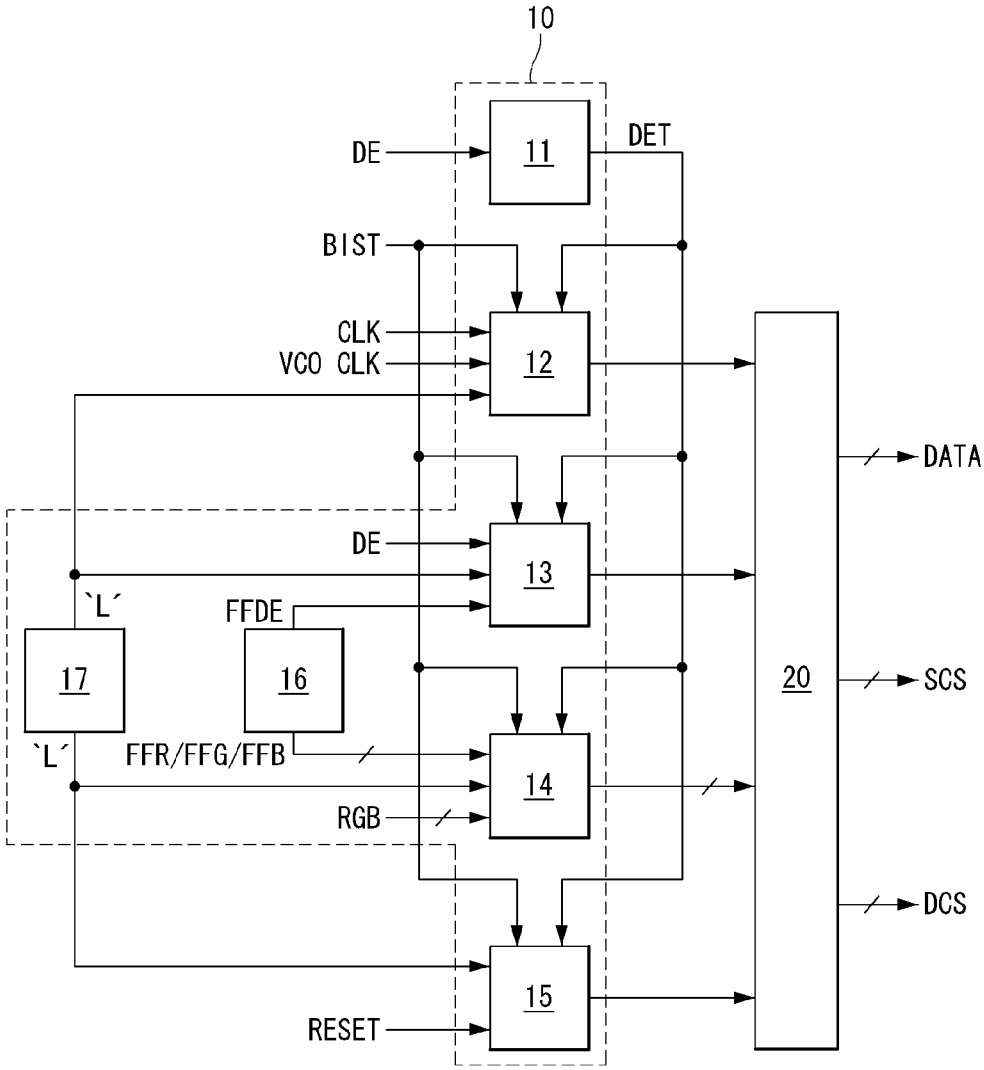
FIG. 2 is a block diagram of a timing controller shown in FIG. 1.
Figure 4:
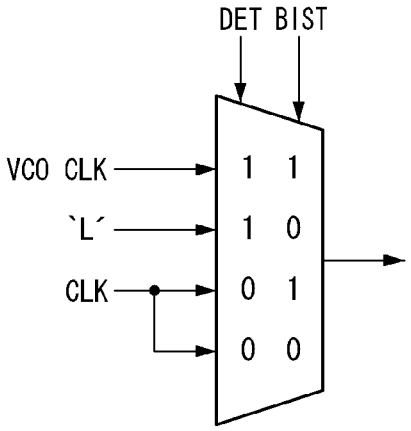
FIG. 4 is a block diagram of an exemplary clock selection output unit shown in FIG. 2.
Figure 5:
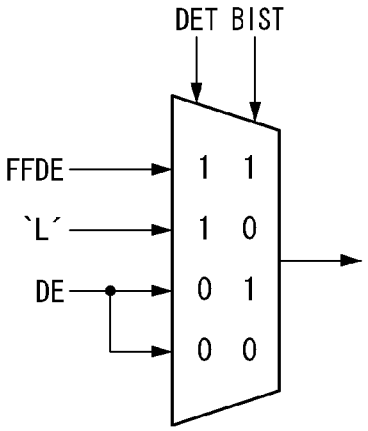
FIG. 5 is a block diagram of an exemplary data enable selection output unit shown in FIG. 2.
Figure 6:
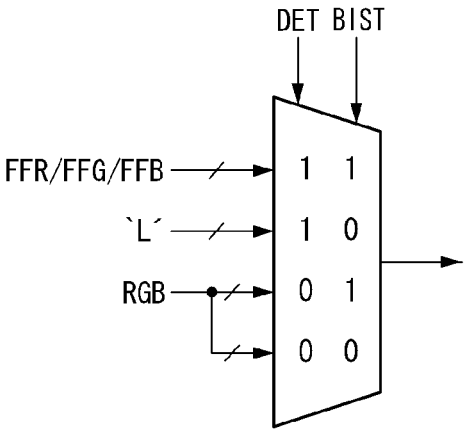
FIG. 6 is a block diagram of an exemplary data selection output unit shown in FIG. 2.
Figure 7:
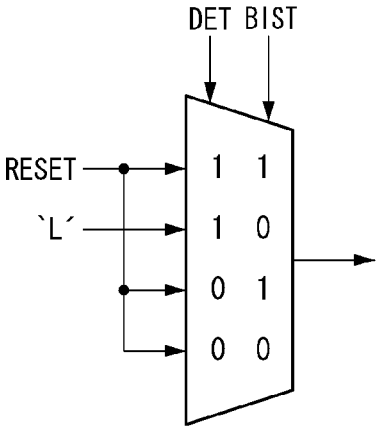
FIG. 7 is a block diagram of an exemplary reset signal selection output unit shown in FIG. 2.

FIG. 2 is a block diagram of an exemplary timing controller 100. FIG. 3 is a table illustrating outputs of a clock selection output unit, a data enable selection output unit, a data selection output unit, and a reset signal selection output unit in response to the BIST signal and a DET signal. FIG. 4 is a block diagram of the clock selection output unit shown in FIG. 2. FIG. 5 is a block diagram of an exemplary data enable selection output unit shown in FIG. 2. FIG. 6 is a block diagram of an exemplary data selection output unit shown in FIG. 2. FIG. 7 is a block diagram of the reset signal selection output unit shown in FIG. 2. The timing controller 100 is described below in detail with reference to FIGS. 2 to 7.

As shown in FIG. 2, the timing controller 100 may include a timing signal selection output unit 10 and a timing logic processing unit 20. The timing signal selection output unit 10 decides whether or not the RGB data RGB are inputted and selectively outputs the timing signals input to the timing signal selection output unit 10 based on the input or non-input of the RGB data RGB. The timing logic processing unit 20 outputs the digital video data DATA, the scan timing control signal SCS, and the data timing control signal DCS in response to the timing signals output from the timing signal selection output unit 10.

The timing signal selection output unit 10 includes a data input sensing unit 11, a clock selection output unit 12, a data enable selection output unit 13, a data selection output unit 14, a reset signal selection output unit 15, a data generating unit 16, and a low logic level signal generating unit 17.

The data input sensing unit 11 receives the data enable DE from the host system 130 and senses the normal mode or the current saving mode based on the data enable DE. When the data enable DE is inputted from the host system 130, the data input sensing unit 11 senses the normal mode and outputs a DET signal DET of a low logic level. Especially when the data enable DE corresponding to a resolution of the display panel 10 is inputted, the data input sensing unit 11 senses the normal mode. When the data enable DE is not inputted from the host system 130, the data input sensing unit 11 senses the current saving mode and outputs the DET signal DET of a high logic level. Also, when the data enable DE not corresponding to the resolution of display panel 10, the data input sensing unit 11 senses the current saving mode and output the DET signal of a high logic level. The DET signal DET output from the data input sensing unit 11 is inputted to the clock selection output unit 12, the data enable selection output unit 13, the data selection output unit 14, and the reset signal selection output unit 15. The embodiment of the invention describes that the data input sensing unit 11 senses the input of the RGB data RGB using the data enable DE. Other signals may be used. For example, horizontal synchronization signal may be used to sense the input of the RGB data RGB.

The data generating unit 16 receives the VCO clock VCO CLK from the VCO 140. The data generating unit 16 generates an internal data enable FFDE based on the VCO clock VCO CLK and outputs the internal data enable FFDE to the data enable selection output unit 13. The data generating unit 16 generates internal RGB data FFR/FFG/FFB for sequentially implementing previously set images based on the VCO clock VCO CLK and the internal data enable FFDE. The data generating unit 16 outputs the internal RGB data FFR/FFG/FFB to the data selection output unit 14. The internal RGB data FFR/FFG/FFB sequentially outputs red, green, blue, white, and black data. The low logic level signal generating unit 17 generates a low logic level signal 'L,' and outputs it.

As shown in FIG. 2, the clock selection output unit 12 may receive the DET signal DET from the data input sensing unit 11 and also may receive the BIST signal BIST and the dot clock CLK from the host system 130. Further, the clock selection output unit 12 may receive the VCO clock VCO CLK from the VCO 140 and also may receive the low logic level signal 'L,' from the low logic level signal generating unit 17. The clock selection output unit 12 selectively outputs one of signals input based on the DET signal DET and the BIST signal BIST.

More specifically, as shown in FIGS. 3 and 4, when the DET signal DET of the low logic level is inputted to the clock selection output unit 12, the clock selection output unit 12 outputs the dot clock CLK irrespective of the logic level of the BIST signal BIST. For example, however, when the DET signal DET of the high logic level and the BIST signal BIST of the high logic level are inputted to the clock selection output unit 12, the clock selection output unit 12 outputs the VCO clock VCO CLK. Also for example, when the DET signal DET of the high logic level and the BIST signal BIST of the low logic level are inputted to the clock selection output unit 12, the clock selection output unit 12 outputs the low logic level signal 'L.'

As shown in FIG. 2, the data enable selection output unit 13 receives the DET signal DET from the data input sensing unit 11 and receives the BIST signal BIST and the data enable DE from the host system 130. Further, the data enable selection output unit 13 receives the internal data enable FFDE from the data generating unit 16 and receives the low logic level signal 'L,' from the low logic level signal generating unit 17. The data enable selection output unit 13 selectively outputs one of signals input based on the DET signal DET and the BIST signal BIST.

More specifically, as shown in FIGS. 3 and 5, when the DET signal DET of the low logic level is inputted to the data enable selection output unit 13, the data enable selection output unit 13 outputs the data enable DE irrespective of the logic level of the BIST signal BIST. For example, however, when the DET signal DET of the high logic level and the BIST signal BIST of the high logic level are inputted to the data enable selection output unit 13, the data enable selection output unit 13 outputs the internal data enable FFDE received from the data generating unit 16. Also for example, when the DET signal DET of the high logic level and the BIST signal BIST of the low logic level are inputted to the data enable selection output unit 13, the data enable selection output unit 13 outputs the low logic level signal 'L.'

As shown in FIG. 2, the data selection output unit 14 receives the DET signal DET from the data input sensing unit 11 and receives the BIST signal BIST and the RGB data RGB from the host system 130. Further, the data selection output unit 14 receives the internal RGB data FFR/FFG/FFB from the data generating unit 16 and receives the low logic level signal 'L,' from the low logic level signal generating unit 17. The data selection output unit 14 selectively outputs one of signals input based on the DET signal DET and the BIST signal BIST.

More specifically, as shown in FIGS. 3 and 6, when the DET signal DET of the low logic level is inputted to the data selection output unit 14, the data selection output unit 14 outputs the RGB data RGB irrespective of the logic level of the BIST signal BIST. For example, however, when the DET signal DET of the high logic level and the BIST signal BIST of the high logic level are inputted to the data selection output unit 14, the data selection output unit 14 receives the internal RGB data FFR/FFG/FFB from the data generating unit 16. Also for example, when the DET signal DET of the high logic level and the BIST signal BIST of the low logic level are inputted to the data selection output unit 14, the data selection output unit 14 outputs the low logic level signal 'L.'

As shown in FIG. 2, the reset signal selection output unit 15 receives the DET signal DET from the data input sensing unit 11 and receives the reset signal RESET from the reset signal output unit 150. Further, the reset signal selection output unit 15 receives the low logic level signal 'L,' from the low logic level signal generating unit 17. The reset signal selection output unit 15 selectively outputs one of signals input based on the DET signal DET and the BIST signal BIST.

More specifically, as shown in FIGS. 3 and 7, when the DET signal DET of the low logic level is inputted to the reset signal selection output unit 15, the reset signal selection output unit 15 outputs the reset signal RESET irrespective of the logic level of the BIST signal BIST. For example, however, when the DET signal DET of the high logic level and the BIST signal BIST of the high logic level are inputted to the reset signal selection output unit 15, the reset signal selection output unit 15 outputs the reset signal RESET. Also for example, when the DET signal DET of the high logic level and the BIST signal BIST of the low logic level are inputted to the reset signal selection output unit 15, the reset signal selection output unit 15 outputs the low logic level signal 'L.'

The timing logic processing unit 20 receives an output of the clock selection output unit 12, an output of the data enable selection output unit 13, an output of the data selection output unit 14, and an output of the reset signal selection output unit 15. The timing logic processing unit 20 outputs the digital video data DATA, the scan timing control signal SCS, and the data timing control signal DCS in response to the input signals.

As shown in FIG. 3, in the normal mode, the timing logic processing unit 20 receives the dot clock CLK from the clock selection output unit 12, the data enable DE from the data enable selection output unit 13, the RGB data RGB from the data selection output unit 14, and the reset signal RESET from the reset signal selection output unit 15. In the normal mode, the timing logic processing unit 20 outputs the digital video data DATA as the RGB data RGB. Further, the timing logic processing unit 20 generates the scan timing control signal SCS and the data timing control signal DCS based on the dot clock CLK, the data enable DE, the RGB data RGB, and the reset signal RESET and outputs them.

When the BIST signal BIST of the high logic level is generated in the current saving mode, the timing logic processing unit 20 receives the VCO clock VCO CLK from the clock selection output unit 12, the internal data enable FFDE from the data enable selection output unit 13, the internal RGB data FFR/FFG/FFB from the data selection output unit 14, and the reset signal RESET from the reset signal selection output unit 15. Therefore, the timing logic processing unit 20 outputs the digital video data DATA as the internal RGB data FFR/FFG/FFB. Further, the timing logic processing unit 20 generates the scan timing control signal SCS and the data timing control signal DCS based on the VCO clock VCO CLK, the internal data enable FFDE, the internal RGB data FFR/FFG/FFB, and the reset signal RESET and outputs them.

When the BIST signal BIST of the low logic level is generated in the current saving mode, the timing logic processing unit 20 receives the low logic level signal 'L' from the clock selection output unit 12, the low logic level signal 'L' from the data enable selection output unit 13, the low logic level signal 'L' from the data selection output unit 14, and the low logic level signal 'L' from the reset signal selection output unit 15. Therefore, the timing logic processing unit 20 outputs the digital video data DATA, the scan timing control signal SCS, and the data timing control signal DCS as the low logic level signal 'L.'

The dot clock CLK, the data enable DE, etc. are external timing signals received from the outside of the host system 130. The BIST signal BIST, the reset signal RESET, the VCO clock VCO CLK, the internal data enable FFDE, etc. are internal timing signals generated inside the OLED display.

In other words, when the BIST signal BIST of the high logic level is generated in the current saving mode, the timing signal selection output unit 10 may output the timing signals that allow the display panel 200 to display specific pattern image. For example, when the BIST signal BIST of the high logic level is generated in the current saving mode, the timing signal selection output unit 10 can output the timing signals that allow the display panel 200 to display color images, such as red, green, blue, white, and black images. Specifically, each of the color images, such as red, green, blue, white, and black images, can be displayed on each line of the display panel. The display operation can be repeatedly performed on all of the lines of the display panel. Also, when the BIST signal BIST of the high logic level is generated in the current saving mode, the timing signal selection output unit 10 can also output the timing signals that allow the display panel 200 to display each of the color images, such as red, green, blue, white, and black images, in each frame or during a predetermined period. Therefore, it is advantageous that a user can recognize, by viewing the multicolor image, when the multicolor data are not inputted or abnormally inputted.

Further, in some embodiments, when the BIST signal BIST of the low logic level is generated in the current saving mode, the timing signal selection output unit 10 outputs the timing signals, which allow the display panel 200 to display the black image. Thus, all of the clock selection output unit 12, the data enable selection output unit 13, the data selection output unit 14, and the reset signal selection output unit 15 output the low logic level signal 'L.' Further, the timing logic processing unit 20 outputs the digital video data DATA, the scan timing control signal SCS, and the data timing control signal DCS as the low logic level signal 'L.' Accordingly, power consumption of the timing controller 100, the scan driving circuit 110, and the data driving circuit 120 may be reduced. Further, heat generated in the timing controller 100, the scan driving circuit 110, and the data driving circuit 120 may be reduced.

Figure 8:
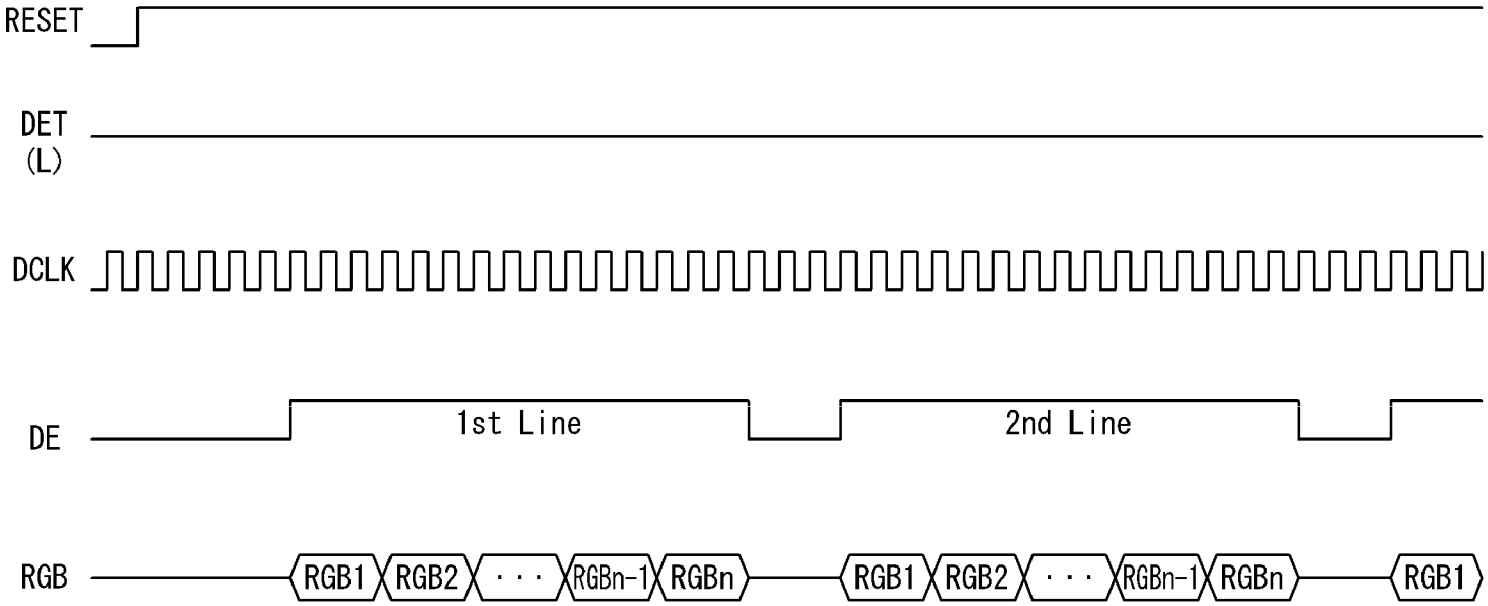
FIG. 8 is a waveform diagram illustrating an output of an exemplary timing controller in response to a DET signal of a low logic level.

FIG. 8 is a waveform diagram illustrating an exemplary output of the timing signal selection output unit 10 in response to the DET signal of the low logic level. As shown in FIG. 8, when the DET signal DET of the low logic level is inputted to the timing signal selection output unit 10, the timing signal selection output unit 10 outputs the dot clock CLK, the data enable DE, the RGB data RGB, and the reset signal RESET. The dot clock CLK is a clock, which has a short cycle and is repeatedly generated. The data enable DE is a signal indicating whether or not the RGB data RGB exist.

First to nth RGB data RGB1-RGBn output to first to nth data lines exist in a high logic level period of the data enable DE, where n is a natural number.

Figure 9:
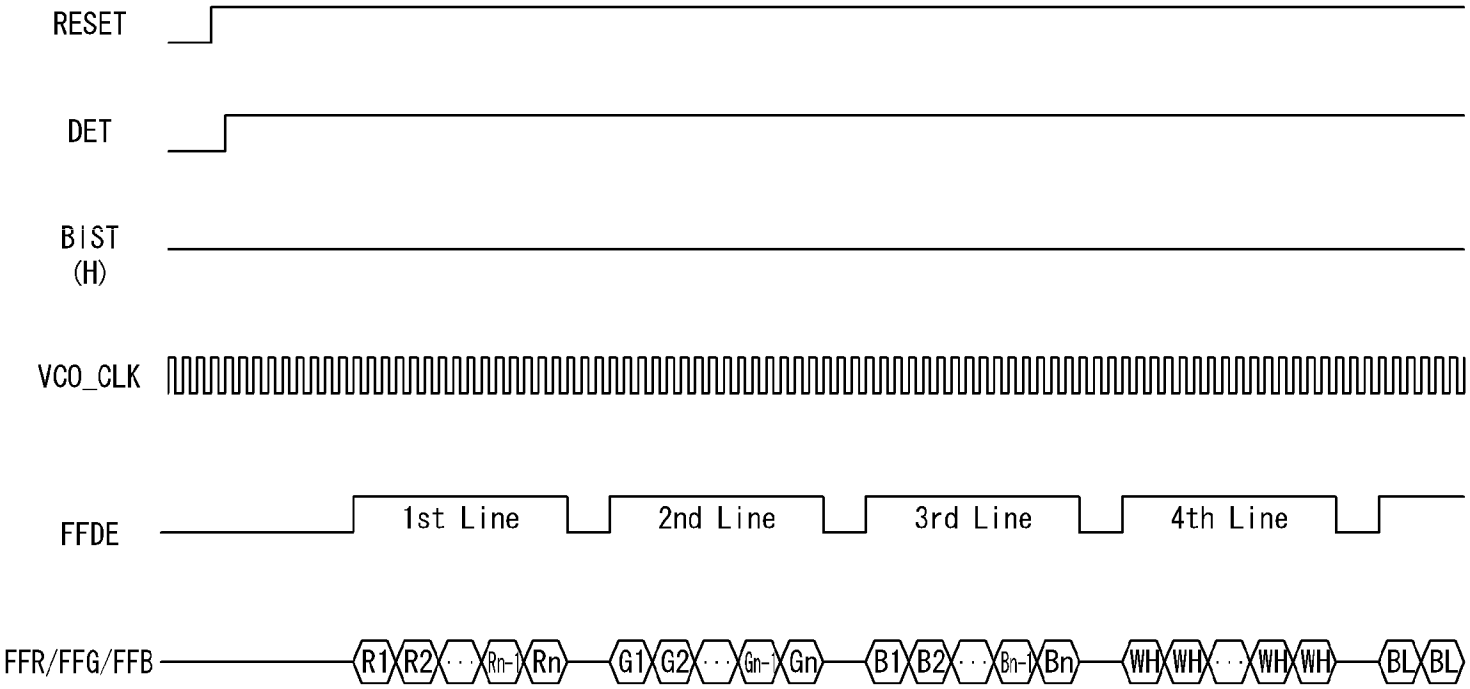
FIG. 9 is a waveform diagram illustrating an output of an exemplary timing controller in response to a DET signal of a high logic level and a BIST signal of a high logic level.

FIG. 9 is a waveform diagram illustrating an exemplary output of the timing signal selection output unit 10 in response to the DET signal of the high logic level and the BIST signal of the high logic level. As shown in FIG. 9, when the DET signal DET of the high logic level and the BIST signal BIST of the high logic level are input to the timing signal selection output unit 10, the timing signal selection output unit 10 outputs the VCO clock VCO CLK, the internal data enable FFDE, the internal RGB data FFR/FFG/FFB, and the reset signal RESET. The VCO clock VCO CLK is a clock that has a shorter cycle than the dot clock CLK and is repeatedly generated. The internal data enable FFDE is a signal indicating whether or not the internal RGB data FFR/FFG/FFB exists. The internal RGB data FFR/FFG/FFB sequentially outputs red, green, blue, white, and black data. First to nth red data R1-Rn, first to nth green data G1-Gn, and first to nth blue data B1-Bn, first to nth white data WH1-WHn, and first to nth black data BL1-BLn, which are output to the first to nth data lines, sequentially exist in a high logic level period of the internal data enable FFDE.

Figure 10:
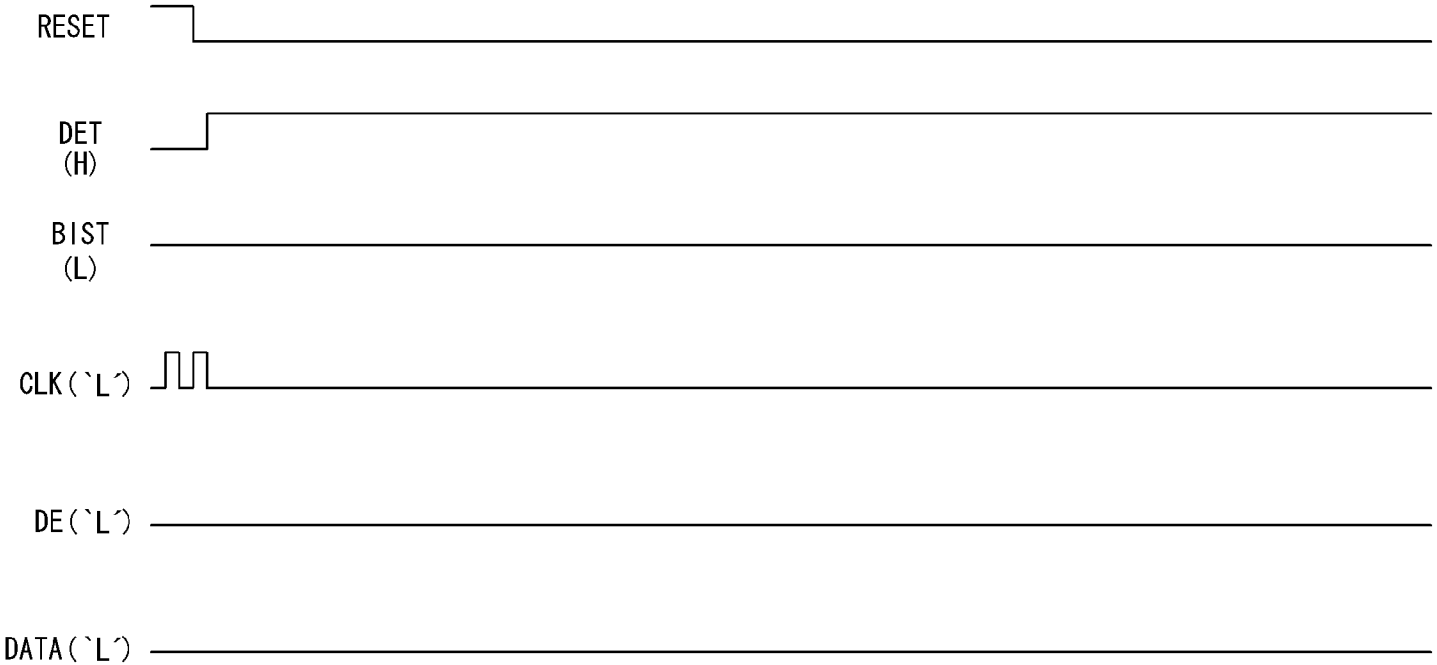
FIG. 10 is a waveform diagram illustrating an output of an exemplary timing controller in response to a DET signal of a high logic level and a BIST signal of a low logic level.

FIG. 10 is a waveform diagram illustrating an exemplary output of the timing signal selection output unit 10 in response to the DET signal of the high logic level and the BIST signal of the low logic level. As shown in FIG. 10, when the DET signal DET of the high logic level and the BIST signal BIST of the low logic level are input to the timing signal selection output unit 10, the timing signal selection output unit 10 outputs the low logic level signals 'L.' The low logic level signal 'L' may be implemented by a ground level voltage (e.g., 0 V). When the low logic level signal 'L' is implemented by the ground level voltage (e.g., 0 V), signals output from the timing signal selection output unit 10 have a voltage of 0 V. Therefore, the power consumption of the timing controller 100 is greatly reduced. Further, because the digital video data DATA, the scan timing control signal SCS, and the data timing control signal DCS output from the timing logic processing unit 20 are the low logic level signals 'L,' the power consumption of the scan driving circuit 110 and the data driving circuit 120 as well as the timing controller 100 may be reduced.

Figure 11A:
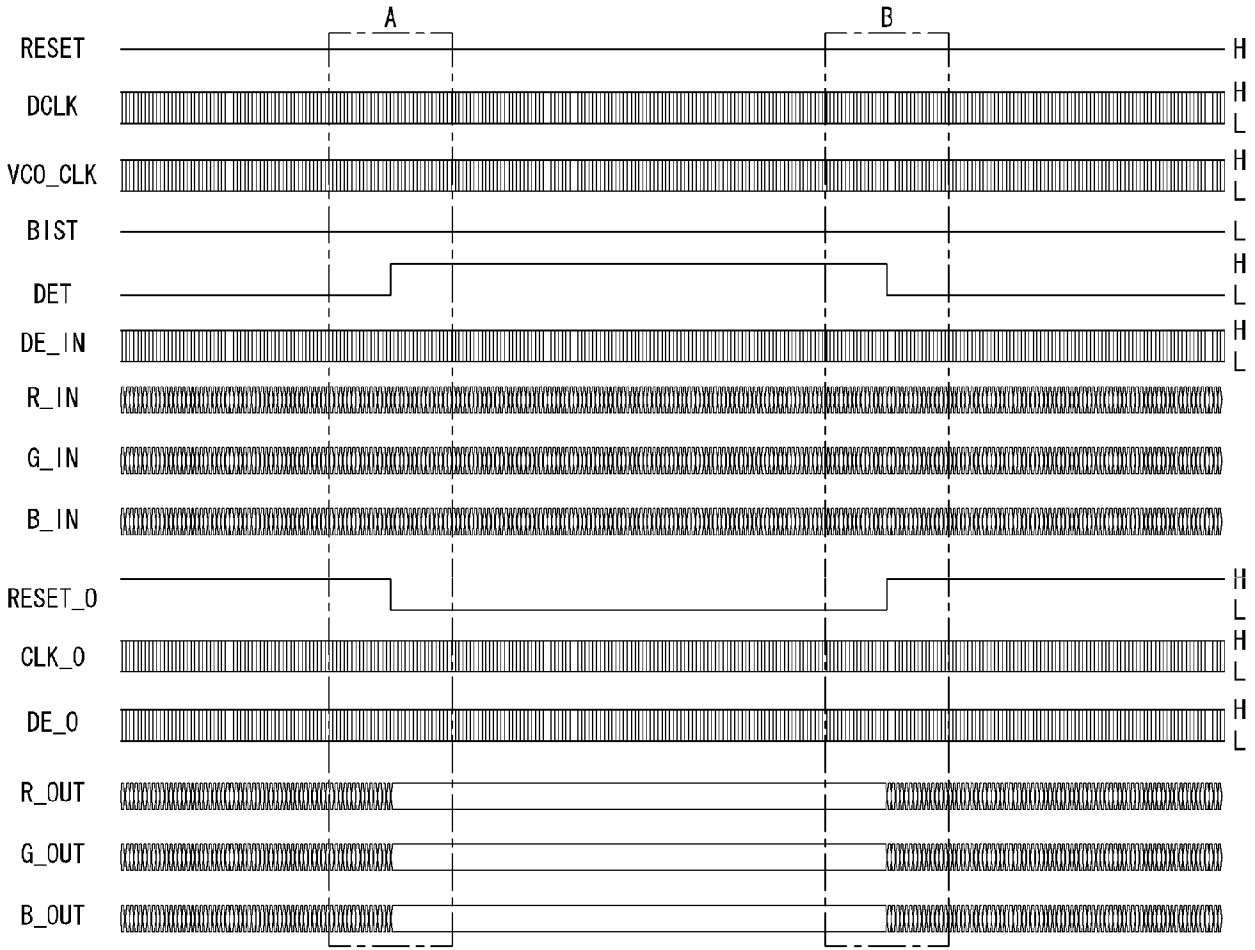
FIGS. 11A to 11C illustrate simulation results of an output of an exemplary timing controller according to an exemplary embodiment of the invention.
Figure 11B:
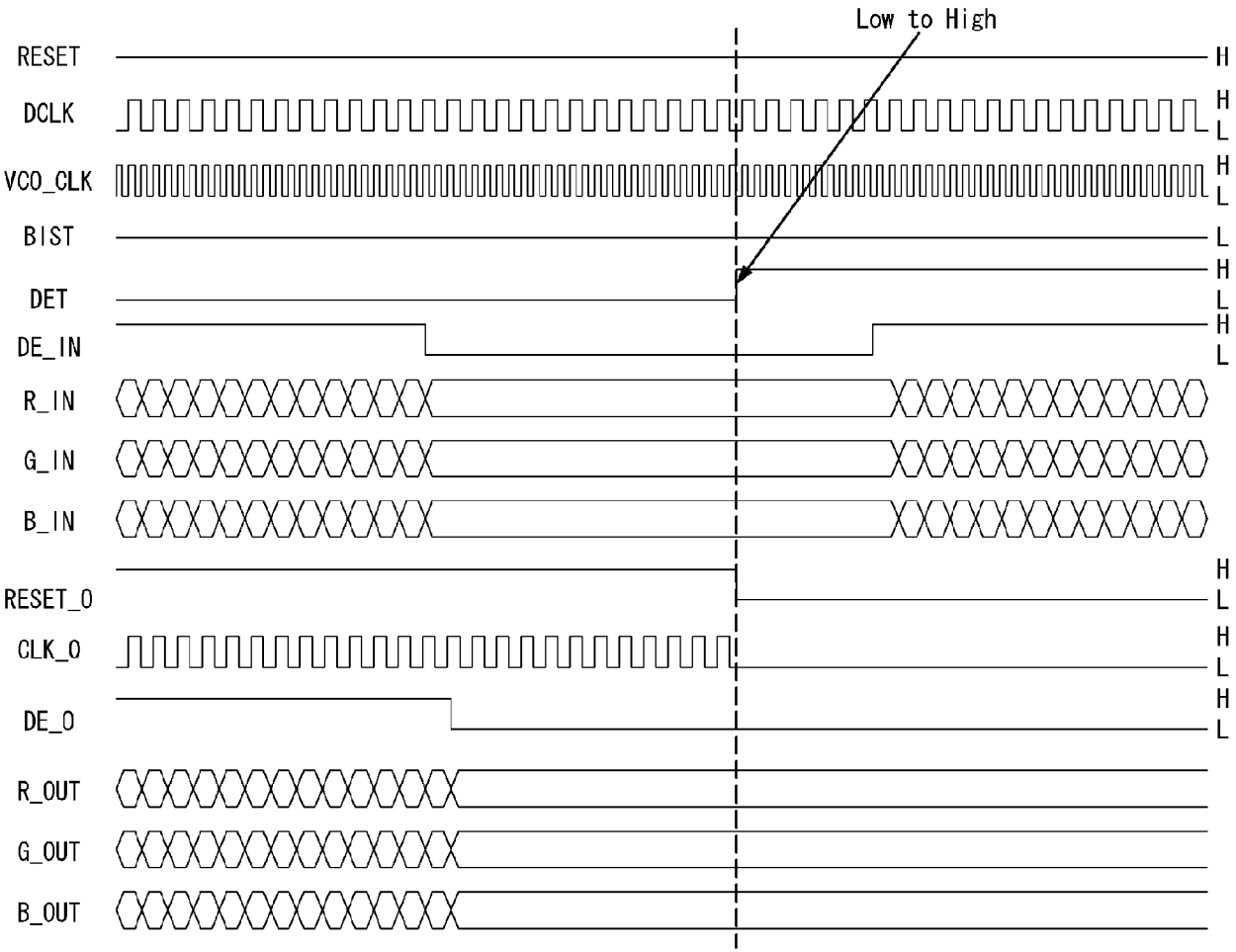
Figure 11C:
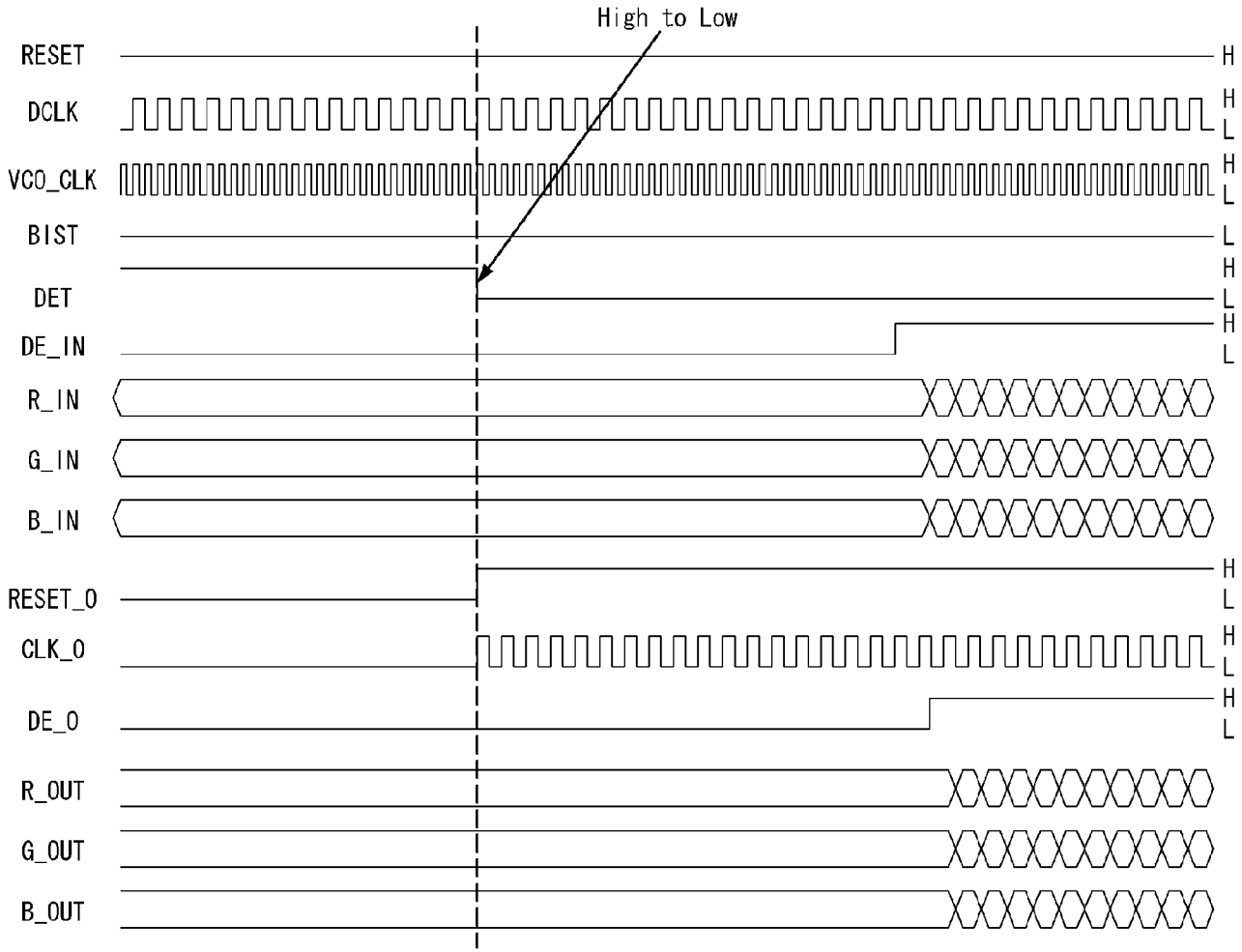

FIGS. 11A to 11C illustrate simulation results of input signals and output signals of the timing signal selection output unit 10 according to the example embodiment of the invention. In FIGS. 11A to 11C, 'BIST' denotes the BIST signal BIST, 'DET' the DET signal DET, 'DCLK' the dot clock CLK input to the clock selection output unit 12, 'VCO_CLK' the VCO clock VCO CLK, 'CLK_O' a signal output from the clock selection output unit 12, 'DE_IN' the data enable DE input to the data enable selection output unit 13, 'DE_O' a signal output from the data enable selection output unit 13, 'R_IN', 'G_IN', and 'B_IN' the RGB data RGB input to the data selection output unit 14, 'R_OUT', 'G_OUT', and 'B_OUT' data output from the data selection output unit 14, 'RESET' the reset signal RESET input to the reset signal selection output unit 15, and 'RESET_O' a signal output from the reset signal selection output unit 15.

In FIG. 11A, a portion A indicates a portion where the DET signal DET rises from the low logic level to the high logic level, and a portion B indicates a portion where the DET signal DET falls from the high logic level to the low logic level. FIG. 11B is an enlarged view of the portion A of FIG. 11A, and FIG. 11C is an enlarged view of the portion B of FIG. 11A.

As shown in FIGS. 11A and 11B, in the portion A where the DET signal DET rises from the low logic level to the high logic level, the timing signal selection output unit 10 outputs the signals in the current saving mode. Because the BIST signal BIST is the low logic level in the portion A, the signals RESET_O, CLK_O, DE_O, R_OUT, G_OUT, and B_OUT are outputted from the timing signal selection output unit 10 as the low logic level signals 'L.'

As shown in FIGS. 11A and 11C, in the portion B where the DET signal DET falls from the high logic level to the low logic level, the timing signal selection output unit 10 outputs the signals in the normal mode. Because the BIST signal BIST is the low logic level in the portion B, the signals RESET_O, CLK_O, DE_O, R_OUT, G_OUT, and B_OUT are output from the timing signal selection output unit 10 without changes in the signals RESET, DCLK, DE_IN, R_IN, G_IN, and B_IN inputted to the timing signal selection output unit 10. The signals RESET_O, CLK_O, DE_O, R_OUT, G_OUT, and B_OUT may be delayed by a predetermined time of period because of the timing signal selection output unit 10.

Figure 12:
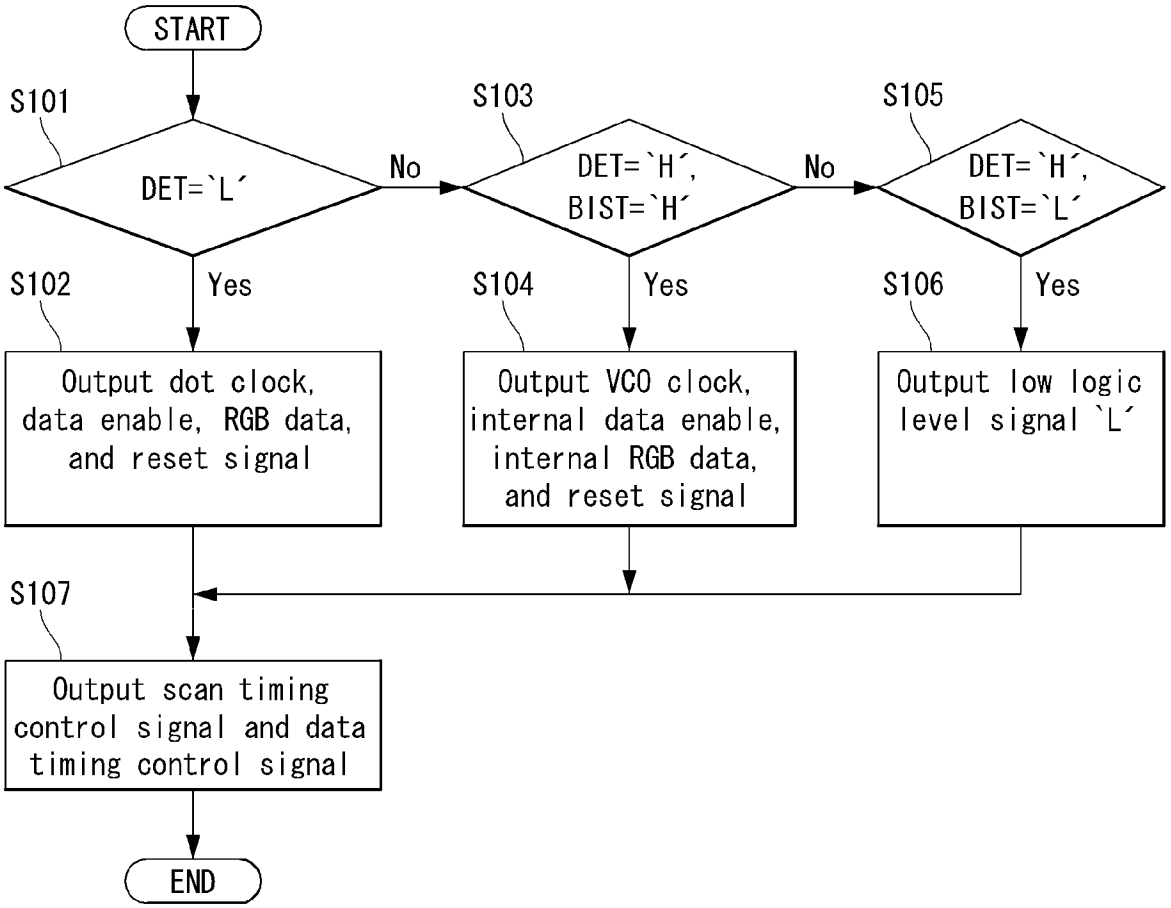
FIG. 12 is a flow chart illustrating an output of an exemplary timing controller according to an exemplary embodiment of the invention.

FIG. 12 is a flow chart illustrating an output of the timing controller according to the example embodiment of the invention. As shown in FIG. 12, each of the clock selection output unit 12, the data enable selection output unit 13, the data selection output unit 14, and the reset signal selection out put unit 15 of the timing signal selection output unit 10 selectively outputs one of signals input based on the DET signal DET and the BIST signal BIST.

When the DET signal DET of the low logic level is inputted, each of the clock selection output unit 12, the data enable selection output unit 13, the data selection output unit 14, and the reset signal selection output unit 15 outputs the signal in the normal mode. More specifically, the clock selection output unit 12 outputs the dot clock CLK, the data enable selection output unit 13 outputs the data enable DE, the data selection output unit 14 outputs the RGB data RGB, and the reset signal selection output unit 15 outputs the reset signal RESET in steps S101 and S102.

When the DET signal DET of the high logic level is inputted, each of the clock selection output unit 12, the data enable selection output unit 13, the data selection output unit 14, and the reset signal selection output unit 15 outputs the signal in the current saving mode. More specifically, because the BIST signal BIST of the high logic level is inputted along with the DET signal DET of the high logic level, each of the clock selection output unit 12, the data enable selection output unit 13, the data selection output unit 14, and the reset signal selection output unit 15 outputs the signal that allows red, green, blue, white, and black data to be sequentially output. Thus, the clock selection output unit 12 outputs the VCO clock VCO CLK, the data enable selection output unit 13 outputs the internal data enable FFDE, the data selection output unit 14 outputs the internal RGB data FFR/FFG/FFB, and the reset signal selection output unit 15 outputs the reset signal RESET in steps S103 and S104.

When the DET signal DET of the high logic level is inputted, each of the clock selection output unit 12, the data enable selection output unit 13, the data selection output unit 14, and the reset signal selection output unit 15 outputs the signal in the current saving mode. More specifically, because the BIST signal BIST of the low logic level is inputted along with the DET signal DET of the high logic level, each of the clock selection output unit 12, the data enable selection output unit 13, the data selection output unit 14, and the reset signal selection output unit 15 outputs the low logic level signal 'L' in steps S105 and S106.

Next, the timing logic processing unit 20 generates the scan timing control signal SCS and the data timing control signal DCS based on the signals output from the clock selection output unit 12, the data enable selection output unit 13, the data selection output unit 14, and the reset signal selection output unit 15 and outputs them in step S107. When all of the clock selection output unit 12, the data enable selection output unit 13, the data selection output unit 14, and the reset signal selection output unit 15 output the low logic level signal 'L,' the timing logic processing unit 20 outputs the scan timing control signal SCS of the low logic level and the data timing control signal DCS of the low logic level. Hence, the power consumption of the timing controller 100, the scan driving circuit 110, and the data driving circuit 120 may be reduced. Further, heat generated in the timing controller 100, the scan driving circuit 110, and the data driving circuit 120 may be reduced.

In other words, in some embodiments of the invention, when the DET signal DET of a first logic level (e.g. the high logic level or the low logic level) is generated, the OLED display may be driven in the current saving mode, and when the DET signal DET of a second logic level (e.g. the low logic level or the high logic level) is generated, the OLED display may be driven in the normal mode. Also, in the embodiment of the invention, when the BIST signal BIST of the first logic level (e.g. the high logic level or the low logic level) is generated, display panel 200 displays a specific pattern image, and when the BIST signal BIST of the second logic level (e.g. the low logic level or the high logic level) is generated, display panel 200 displays black image.

As described above, the OLED display according to some embodiments of the invention decides whether or not the RGB data are inputted, is driven in the normal mode when the RGB data are inputted, and is driven in the current saving mode when the RGB data are not inputted. As a result, when the RGB data are not inputted, the OLED display according to some embodiments of the invention may reduce the power consumption by the timing controller, the scan driving circuit, and the data driving circuit and may also reduce heat generated in the timing controller, the scan driving circuit, and the data driving circuit. Also, when the RGB data are not inputted, the OLED display according to the embodiment of the invention displays a non-black image (e.g. a specific pattern image). As a result, the user recognizes that RGB data are not inputted and/or abnormally inputted.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting diode (OLED) display comprising:

a data driving circuit configured to output a data voltage to the display panel;

a scan driving circuit configured to sequentially output a scan pulse synchronized with the data voltage to a display panel; and a timing controller configured, to control the scan driving circuit and the data driving circuit in a normal mode when timing signals, a built-in self test (BIST) signal, a multicolor data, a voltage controlled oscillator (VCO) clock, and multicolor data are inputted, wherein the timing signals comprise a clock and a data enable, and to control the scan driving circuit and the data driving circuit in a current saving mode when the multicolor data are not inputted, wherein the BIST signal controls the scan timing control signal (SCS) and the data timing control signal (DCS) and allows the display panel to display a pattern image or a black image in the current saving mode.

2. The OLED display of claim 1, further comprising:

a host system configured to output the BIST signal, the multicolor data, and the timing signals indicating whether or not multicolor data are inputted; and a VCO configured to output the VCO clock to the timing controller.

3. The OLED display of claim 2, wherein in the normal mode, the timing controller outputs a scan timing control signal for controlling the scan driving circuit and a data timing control signal for controlling the data driving circuit based on the external timing signals, and outputs video data as the multicolor data, wherein when the BIST signal of a first logic level is inputted in the current saving mode, the timing controller outputs the scan timing control signal and the data timing control signal that allow the display panel to display a pattern image, based on the VCO clock and an internal timing signal, and outputs the video data as internal multicolor data, and wherein when the BIST signal of a second logic level is inputted in the current saving mode, the timing controller outputs the scan timing control signal and the data timing control signal as a low logic level signal based on signals of the low logic level that are internally generated so as to allow the display panel to display a black image, and outputs the video data as the low logic level signal.

4. The OLED display of claim 3, further comprising a reset signal output unit configured to output a reset signal that is a start signal of timing logic processing of the timing controller to the timing controller.

5. The OLED display of claim 4, the timing controller comprises:

a data input sensing unit configured to sense the current saving mode and output a DET signal of the first logic level when the data enable is not inputted, and to sense the normal mode and output a DET signal of the second logic level when the data enable is inputted;

a data generating unit configured to generate an internal data enable based on the VCO clock, to generate the internal multicolor data that sequentially outputs multiple color data in a high logic level period of the internal data enable, and output the internal data enable and the internal multicolor data;

a low logic level signal generating unit configured to generate the low logic level signal and output the low logic level signal;

a clock selection output unit configured to selectively output one of the dot clock, the VCO clock, and the low logic level signal based on the DET signal and the BIST signal;

a data enable selection output unit configured to selectively output one of the data enable, the internal data enable, and the low logic level signal based on the DET signal and the BIST signal;

a data selection output unit configured to selectively output one of the multicolor data, the internal multicolor data, and the low logic level signal based on the DET signal and the BIST signal; and a reset signal selection output unit configured to selectively output one of the reset signal and the low logic level signal based on the DET signal and the BIST signal.

6. The OLED display of claim 5, wherein when the DET signal of the second logic level is inputted, the clock selection output unit outputs the dot clock, the data enable selection output unit outputs the data enable, the data selection output unit outputs the multicolor data, and the reset signal selection output unit outputs the reset signal.

7. The OLED display of claim 4, wherein the timing controller further comprises a timing logic processing unit configured to output the scan timing control signal and the data timing control signal based on the dot clock, the data enable, the multicolor data, and the reset signal.

8. The OLED display of claim 5, wherein when the DET signal of the first logic level and the BIST signal of the first logic level are input, the clock selection output unit outputs the VCO clock, the data enable selection output unit outputs the internal data enable, the data selection output unit outputs the internal multicolor data, and the reset signal selection output unit outputs the reset signal.

9. The OLED display of claim 7, wherein the timing controller further comprises a timing logic processing unit configured to output the scan timing control signal and the data timing control signal based on the VCO clock, the internal data enable, the internal multicolor data, and the reset signal.

10. The OLED display of claim 5, wherein when the DET signal of the first logic level and the BIST signal of the second logic level are input, each of the clock selection output unit, the data enable selection output unit, the data selection output unit, and the reset signal selection output unit outputs the low logic level signal.

11. The OLED display of claim 10, wherein the timing controller further comprises a timing logic processing unit configured to output the scan timing control signal of the low logic level and the data timing control signal of the low logic level.

12. A method for driving organic light emitting diode (OLED) display comprising the step of:

(a) outputting a data voltage to the display panel;

(b) outputting a scan pulse synchronized with the data voltage to a display panel; and (c) controlling a scan driving circuit and a data driving circuit in a normal mode when timing signals, a built-in self test (BIST) signal, a multicolor data, a voltage controlled oscillator (VCO) clock, and multicolor data are inputted, and controlling the scan driving circuit and the data driving circuit in a current saving mode when the multicolor data are not inputted, and wherein the BIST signal controls the scan timing control signal (SCS) and the data timing control signal (DCS) and allows the display panel to display a pattern image or a black image in the current saving mode.

13. The method of claim 12, further comprising:

a host system configured to output the BIST signal, the multicolor data, and the timing signals indicating whether or not multicolor data are inputted; and a VCO configured to output the VCO clock to the timing controller.

14. The method of claim 13, wherein the step (c) comprises:

in the normal mode, outputting the scan timing control signal and the data timing control signal for controlling the scan pulse and the data voltage based on the external timing signals, and outputting video data as the multicolor data, when the BIST signal of a first logic level is inputted in the current saving mode, outputting the scan timing control signal and the data timing control signal that allow the display panel to display a pattern image, based on the VCO clock and an internal timing signal, and outputting the video data as internal multicolor data, and when the BIST signal of a second logic level is inputted in the current saving mode, outputting the scan timing control signal and the data timing control signal as a low logic level signal based on signals of the low logic level that are internally generated so as to allow the display panel to display a black image, and outputting the video data as the low logic level signal.

15. The method of claim 14, further comprising the step of outputting a reset signal that is a start signal of timing logic processing of the timing controller to the timing controller.

16. The method of claim 15, wherein the step (c) comprises:

sensing the current saving mode and outputting the DET signal of the first logic level when the data enable is not inputted, and sensing the normal mode and outputting a DET signal of the second logic level when the data enable is inputted;

generating an internal data enable based on the VCO clock, generating the internal multicolor data, that sequentially outputs red, green, blue, white, and black data in a high logic level period of the internal data enable, and outputting the internal data enable and the internal multicolor data;

generating the low logic level signal and output the low logic level signal;

selectively outputting one of the dot clock, the VCO clock, and the low logic level signal based on the DET signal and the BIST signal;

selectively outputting one of the data enable, the internal data enable, and the low logic level signal based on the DET signal and the BIST signal;

selectively outputting one of the multicolor data, the internal multicolor data, and the low logic level signal based on the DET signal and the BIST signal; and selectively outputting one of the reset signal and the low logic level signal based on the DET signal and the BIST signal.

17. The method of claim 16, wherein when the DET signal of the second logic level is inputted, outputting the dot clock, the data enable, the multicolor data, and the reset signal.

18. The method of claim 17, wherein the step (c) further comprises outputting the scan timing control signal and the data timing control signal based on the dot clock, the data enable, the multicolor data, and the reset signal.

19. The method of claim 16, wherein when the DET signal of the first logic level and the BIST signal of the first logic level are input, outputting the VCO clock, the internal data enable, the internal multicolor data, and the reset signal.

20. The method of claim 19, wherein the step (c) further comprises outputting the scan timing control signal and the data timing control signal based on the VCO clock, the internal data enable, the internal multicolor data, and the reset signal.

21. The method of claim 16, wherein when the DET signal of the first logic level and the BIST signal of the second logic level are input, outputting the low logic level signals.

22. The method of claim 21, wherein the step (c) further comprises outputting the scan timing control signal of the low logic level and the data timing control signal of the low logic level.

23. The OLED display of claim 1, wherein the multicolor data are red-green-blue (RGB) data.

24. The method of claim 12, wherein the multicolor data are red-green-blue (RGB) data.

* * * * *